US005305741A

United States Patent [19]

Moles

[11] Patent Number: 5,305,741

[45] Date of Patent: Apr. 26, 1994

[54] CUSTOMIZABLE MOUTHPIECE FOR DIVERS AND METHOD OF MANUFACTURE

[75] Inventor: Randall C. Moles, Racine, Wis.

[73] Assignee: CGM, Inc., Racine, Wis.

[21] Appl. No.: 929,162

[22] Filed: Aug. 12, 1992

Related U.S. Application Data

[63] Continuation-in-part of Ser. No. 721,127, Jun. 26, 1991, abandoned, which is a continuation-in-part of Ser. No. 380,397, Jul. 17, 1989, Pat. No. 5,031,611.

[51] Int. Cl.[5] ..... B63C 11/16; A61M 16/00; A62B 9/06

[52] U.S. Cl. ..... 128/207.14; 128/201.11

[58] Field of Search ..... 128/201.11, 200.24, 128/207.14, 857, 859, 861, 862, 200.26, 201.26, 201.27, 206.29, DIG. 26, 911, 912; 433/6, 215, 229

[56] References Cited

U.S. PATENT DOCUMENTS

| | | | |
|---|---|---|---|
| 246,671 | 12/1977 | Ceraiway | D29/7 |
| 2,678,043 | 5/1954 | Stark | 128/136 |
| 3,107,667 | 10/1963 | Moore | 128/136 |
| 3,844,281 | 10/1974 | Shamlian | 128/147 |
| 3,929,548 | 12/1975 | Shamlian | 156/245 |
| 3,993,060 | 11/1976 | Mitchell | 128/145 |
| 4,031,888 | 6/1977 | Walters | 128/145 A |
| 4,066,077 | 1/1978 | Shamlian | 128/145 A |
| 4,136,689 | 1/1979 | Shamlian | 128/147 |
| 4,230,106 | 10/1980 | Geeslin et al. | 128/201.11 |
| 4,516,938 | 5/1985 | Hall | 433/215 |
| 4,608,021 | 8/1986 | Barrett | 433/229 |
| 4,610,246 | 9/1986 | Delphia | 128/201.11 |
| 4,631,030 | 12/1986 | von Weissenfluh | 433/149 |
| 4,664,109 | 5/1987 | Rasocha | 128/207.14 |
| 4,673,353 | 6/1987 | Nevin | 433/90 |
| 4,818,231 | 4/1989 | Steiner et al. | 433/215 |
| 4,836,782 | 6/1989 | Gonser | 433/229 |
| 4,848,365 | 7/1989 | Guarlotti et al. | 128/859 |
| 4,860,739 | 8/1989 | Vandepol | 128/201.11 |
| 4,862,903 | 9/1989 | Campbell | 128/861 |
| 5,048,519 | 9/1991 | Kasama et al. | 128/207.14 |
| 5,062,422 | 11/1991 | Kinkade | 128/207.14 |

OTHER PUBLICATIONS

*Hawley's Condensed Chemical Dictionary*, "rubber", pp. 1016–1018, 11th ed., ISBN:0-442-280971, ©1987.

*Primary Examiner*—Edgar S. Burr
*Assistant Examiner*—Kimberly L. Asher
*Attorney, Agent, or Firm*—Jansson & Shupe, Ltd.

[57] ABSTRACT

A customizable scuba-diving mouthpiece having a passageway-forming front member extending from a proximal in-mouth end to a distal outside end, and a U-shaped thermoformable back member preferably formed in situ on the front member. The back member has a forward middle portion, flanges and bite portions configured to provide moldability at substantially all points of contact between mouthpiece and teeth such that the mouthpiece has a secure grip on the diver's teeth. The method for making such customizable mouthpiece.

17 Claims, 3 Drawing Sheets

CUSTOMIZABLE MOUTHPIECE FOR DIVERS AND METHOD OF MANUFACTURE

Related Application

This application is a continuation-in-part of my U.S. patent application Ser. No. 07/721,127, filed Jun. 26, 1991, entitled CUSTOMIZABLE MOUTHPIECE FOR DIVERS AND METHOD OF MANUFACTURE, now abandoned, which is a continuation-in-part of my U.S. patent application Ser. No. 07/380,397, filed Jul. 17, 1989, entitled CUSTOMIZED SCUBA-DIVING MOUTHPIECE AND METHOD OF MANUFACTURE, now issued as U.S. Pat. No. 5,031,611.

FIELD OF THE INVENTION

This invention is related generally to scuba-diving mouthpieces and, more particularly, to mouthpieces of the type customizable for individual divers.

BACKGROUND OF THE INVENTION

Scuba-diving mouthpieces of various kinds have been known and used for many years. The great majority of such mouthpieces are not customizable for individual divers, but some customizable scuba-diving mouthpieces have been known or used. Examples of customized or customizable scuba-diving mouthpieces are those shown in U.S. Pat. Nos. 3,107,667 (Moore), 3,844,281 (Shamlian), 3,929,548 (Shamlian), and 4,136,689 (Shamlian).

Despite advances in recent years, there are many problems and shortcomings with scuba-diving mouthpieces of the prior art. One fairly common problem relates to mouth fatigue experience by scuba divers. Mouthpieces are typically held in place by means of the diver's bite on retaining members which project inwardly from a lip-engaging portion to positions between the upper and lower teeth. This not only places significant pressures on small portions of the diver's teeth, that is, the portions engaging the retaining members, but the constant muscle pressure needed for secure retention of such mouthpieces can cause significant muscle strain and aching.

Customizing the surfaces of such retaining members to match the tooth surfaces, as in the above-mentioned Shamlian patents, ameliorates the problem to some extent. However, the improvement is very limited because of the fact that contact with the inwardly-projecting retaining members is limited to only a few teeth.

Greater tooth contact is possible with scuba-diving mouthpieces such as the customized mouthpiece disclosed in the above-mentioned Moore patent. The tooth-engaging portions in such device extend well back along the line of molars on either side of the mouth. Such extension provides a greater lever arm, thereby reducing the pressure necessary to hold the mouthpiece in the mouth. Because of this, mouth fatigue should be reduced. However, the process used to manufacture such mouthpiece is extremely complex, requiring steps such as making wax replicas of the maxillary and mandibular impressions of the mouth, mounting such replicas in the appropriate relative positions of the partly-opened mouth, carving, uniting tube and tooth impression portions, plaster forming, introducing vulcanizable rubber, separating plaster from formed rubber, and other steps.

The complexity of this manufacturing process rules out quick preparation, such as in a diving equipment shop. Furthermore, it can produce mouthpieces which are less than satisfactory in comfort. In some cases, this is because the relative positions of the relative maxillary and mandibular portions may not be natural. In other cases, this may be because the relative positions are not sufficiently closed. The problem of unnatural jaw position placement is accentuated for the 20% or so of the population whose jaws are developed well away from normal patterns. In each case, improper relative placement, even in customized scuba-diving mouthpieces, exacerbates the usual problems of jaw fatigue.

The problems of jaw fatigue and joint strain during long use are accompanied by a related problem—a tendency toward an inability by the diver to easily maintain the mouthpiece in the proper orientation, particularly when pressures are applied to the mouthpiece from outside the diver's mouth. Unwanted pressures on the mouthpiece grip come about from water currents (relative to the diver), contacts made with diving apparatus, and a variety of other causes. It is essential, of course, that the diver's mouthpiece, which is the sole source of air, remain in place. Thus, the concern about pressure interfering with the grip of the diver on his or her mouthpiece is more than a casual concern.

Some problems with current scuba-diver mouthpieces can be understood better by reference to the mouth, the jaw, and the teeth of a typical person. The jawbone is a lengthy angled member which pivots with respect to the skull about the jaw joint well back from the mouth. Such joint is typically positioned considerably above the level of the teeth and well behind the position of the teeth. From such joint, the jaw has a generally downwardly and slightly forwardly extending portion which extends generally to a position rearwardly spaced from the teeth, and a more forwardly, but still downwardly, extending portion which carries the teeth of the lower jaw and extends forwardly beneath the upper jaw. The angle between the two portions of the lower jaw is referred to herein as the "jaw angle."

Opening and closing muscle tissue masses are secured to the jaw at positions forward of the jaw joint, but well rearward of the teeth. The muscles secured to the lower jaw create a lever arm which extends from the jaw joint all the way to the point of contact pressure of the lower jaw with the upper jaw or with whatever is being bitten.

When using a typical diving mouthpiece, or a customized diving mouthpiece such as those shown in the aforementioned Shamlian patents, the lever arm of the lower jaw extends from the jaw joint all the way forward to the position of the eye teeth where the mouthpieces are gripped between the diver's teeth.

Two separate problems are created when the mouthpiece contact occurs in this manner at such forward position in the mouth: First, since the distance from the center of muscle effort is long, a significant increase in muscle force is necessary to stabilize and retain the mouthpiece. This is what causes the muscles to quickly fatigue and often to become painful, which leads to jaw aches and headaches. A second and related problem of such long lever arm is created when standard mouthpieces, or customized mouthpieces of the Shamlian type are used, in that there is a severe increase in pressure within the jaw joint, well back in the head.

If the contact location is extended to the back of the mouth, the lever arm is shortened and advantages are achieved, including a reduction in the muscle force necessary to hold the mouthpiece and a reduction in the corresponding jaw pressure. Lengthening the mouthpiece retention piece to allow contact at a more rearward position in the mouth creates a shorter, and thus more favorable, lever arm. This resists torque from movement of the diver's regulator. That is, a better grip can be maintained with less exertion.

However, extension of the posterior bite pieces has been difficult or unworkable in the prior art due to variability in the jaw alignment of different people. Only a completely customized bite portion would allow for this. The variability in the angle between the teeth of the upper and lower jaws is a major problem. Such variability is caused by variations in the aforementioned lower jaw angle and also by the angle of the upper jaw with respect to the lower jaw. The upper jaw may be tipped up or down in the front or back.

Another major problem with previous customizable mouthpieces is caused by the extreme variability of the front teeth (incisors) in their generally vertical direction relative to the back teeth. When these teeth extend downwardly more than the average distance, they tend to partially the cover the air intake of the mouthpiece. When the diver bites on the bite portions, this creates a partial reduction in air flow and increased turbulence. The diver tends to experience "starving" for air in this circumstance. Mouthpieces of the prior art have maintained the lower front flange of the mouthpiece at a position vertically directly below the upper flange. However, when the typical jaw opens it follows a variable path that is down and back. At a position 4–6 cms open, which is the average mouth opening for a diving mouthpiece, the lower jaw typically must come forward to grip the bite portions and seal against the lower front flange. This tends to cause significant muscle strain, and places the jaw joint in an unnatural position, with a heavy load on it.

Known customizable scuba-diving mouthpieces have been unable to easily and properly accommodate a wide variety of mouth and tooth configurations. It would be desirable to have a customizable scuba-diving mouthpiece which can provide excellent and easy diver engagement for a wide variety of divers.

There are other problems related to creation of a totally customizable scuba-diving mouthpiece. With broad-reaching customizability there come problems in maintaining strength and integrity in the mouthpiece, at points of pressure and torque. For example, materials which are both readily thermoformable and of acceptable flexibility may be weakened by torque applied at certain points. More specifically, a torque applied on the mouthpiece can cause tearing of such material unless mouthpiece construction and design are such as to minimize or rule out such risk of damage. Furthermore, it is necessary that customizing of critical surfaces of such a mouthpiece be carried out without degrading the structural integrity and strength of the mouthpiece.

Still another concern with customized scuba-diving mouthpieces of the prior art is that such mouthpieces do not very well accommodate what is referred to by divers as "buddy-breathing." Buddy-breathing involves use of a single mouthpiece by more than one diver, as may be necessary when the oxygen supply of one diver is low. In such situations, the mouthpiece is handed back and forth for alternating use by two divers. Customized mouthpieces of the prior art are not well suited for this practice. This is particularly true for mouthpieces having extended tooth engagement along either side of the diver's mouth.

Problems in manufacture can arise in the final customizing steps, that is, in fitting a customizable scuba-diving mouthpiece for a particular diver. While it is desirable to have a large area of customized tooth mouthpiece engagement, heating of the mouthpiece could lead to unacceptable deformation in areas not to be engaged by the mouth, for example, areas to engage the air conduit of a second-stage regulator. It would be desirable to have a customizable mouthpiece not susceptible to such problems.

While there have been a number of efforts to make improved customizable scuba-diving mouthpieces, there has remained a clear need for significant improvements in the field of customizable scuba-diving mouthpieces.

OBJECTS OF THE INVENTION

It is an object of this invention to provide an improved customizable scuba-diving mouthpiece which overcomes some of the problems and shortcomings of the prior art.

Another object of this invention is to provide an improved manufacturing method for customizable scuba-diving mouthpieces.

Another object is to provide an improved scuba-diving mouthpiece which minimizes or eliminates diver fatigue of the type associated with holding the mouthpieces.

Another object of this invention is to provide an improved customized scuba-diving mouthpiece having increased tooth-engaging contact to minimize gripping pressures.

Another object of this invention is to provide an improved customized mouthpiece which causes little or no air turbulence during breathing.

Another object of this invention is to provide an improved scuba-diving mouthpiece which eliminates damage to the jaw joint or pain in said joint, even during long usage.

Another object of this invention is to provide an improved customizable scuba-diving mouthpiece which is readily customizable for the most common mouth and jaw configurations.

Still another object of this invention is to provide an improved customized scuba-diving mouthpiece which easily resists torque from movement from the diver's regulator.

Another object of this invention is to provide an improved customizable scuba-diving mouthpiece requiring minimal muscle pressure to be maintained in position during use.

Another object of this invention is to provide an improved customizable mouthpiece which may be made using a simplified manufacturing method.

Another object of this invention is to provide an improved customizable scuba-diving mouthpiece which better accommodates divers with significant variations in jaw positions and configurations.

Another object of this invention is to provide an improved customizable scuba-diving mouthpiece which avoids problems during customizing for a particular diver.

Another object of this invention is to provide an improved custom mouthpiece with improved accommodation of "buddy-breathing."

These and other important objects will be apparent from the descriptions of this invention which follow.

SUMMARY OF THE INVENTION

This invention is an improvement in scuba-diving mouthpieces and, more specifically, an improved customizable scuba-diving mouthpiece of the type including a front breathing hole and rear portions customizable for a particular diver. The invention also involves an improved method for manufacture of customizable mouthpieces. The invention overcomes certain of the problems and shortcomings of the prior art, including those noted above.

The customizable scuba-diving mouthpiece of this invention includes a front member which extends from a proximal in-mouth end to a distal outside end and forms a horizontal passageway from the distal end to the proximal end, and a U-shaped thermoformable back member which is configured to allow customizing such that there is substantial engagement with many surfaces of a user's teeth.

The thermoformable back member includes a forward middle portion which is secured to the front member proximal end, and a pair of leg portions extending from the middle portion rearwardly to pass between the diver's molars and terminate at the rear of the mouth. Each leg portion has inner and outer upstanding flanges and a substantially horizontal bite portion which extends therebetween. The flanges having upwardly-extending and downwardly-extending flange portions with upper and lower edges, respectively, and inside surfaces spaced for engagement with the side surfaces of the user's teeth. The outer flanges extend forward to merge with the forward middle portion. The forward middle portion, flanges and bite portions provide moldability at substantially all points of contact between mouthpiece and teeth such that the mouthpiece grips the diver's teeth.

In highly preferred embodiments, the thermoformable back member is secured to the front member by in situ formation thereon. It is preferred that the front member have a groove near its proximal end to facilitate interconnection of the back and front members, by in situ formation of the back member on the front member.

In highly preferred embodiments, at least a major portion of the front member is of a material which is not thermoformable during customizing of the back member to the teeth and mouth of the diver. Thus, the front member aids in mouthpiece shape retention and avoidance of passageway constriction.

In the most preferred embodiments, the front member includes a substantially rigid non-thermoformable core member which extends from the proximal in-mouth end forwardly to a position short of the distal outside end and forms part of the horizontal passageway. In such embodiments, the front member also has a remaining portion which covers the core member and extends forwardly beyond the core member to form the distal outside end and another part of the horizontal passageway. Such front member remaining portion is preferably formed of the same thermoformable material as is used to form the back member; indeed, such front member remaining portion and back member are integrally formed into connection with the core member of the front member during a single molding step.

The bite portions preferably have a vertical thickness (Y) of at least about 4 mm, which provides both good moldability and structural integrity. The horizontal dimension (X) of each flange portion along the adjacent bite portion at a position midway between its edge and the bite portion is such that X:Y is about 1:3–1:1. This also tends to provide both good moldability and structural integrity.

In highly preferred embodiments, the intersections of the flange inside surfaces with their adjacent bite portion are beveled to increase customized tooth-surface engagement. This allows the mouthpiece to grip even more firmly onto the user's teeth. "Beveled," as used herein, includes both planar bevels, such as at 45 degrees to the bevel and to the adjacent bite portion, and substantial rounding, that is, rounding such that flange horizontal width just above the bite portion is at least about 1.5, and preferably at least about two times the horizontal dimension (X) of each flange portion at a position midway between its edge and the bite portion.

In certain preferred embodiments, the horizontal dimension ($X_o$) of the outer flanges at a position forward of the bite portions is such that $X_o$:Y is about 1:1–3:1. This provides good torsional rigidity to resist twisting forces imposed on the mouthpiece during use.

In some preferred embodiments, the bite portions extend rearwardly beyond the upstanding flanges. This facilitates custom engagement between the diver's full molar set without impinging upon sensitive gum tissue in constricted areas of the mouth.

In some preferred embodiments, the upper and lower edges of the flanges converge rearwardly. This serves to facilitate custom engagement with a diver's molar sides while avoiding impingement upon sensitive gum tissue in constricted areas of the mouth.

In preferred embodiments, the outer flange is angled substantially off-vertical along the forward middle portion to accommodate typical mouth/tooth orientations. The downwardly-extending portion of the outer flange, along the back member forward middle portion, may be rearwardly offset with respect to the upwardly-extending portion of the outer flange.

Another aspect of this invention is the method for making a scuba-diving mouthpiece of the type described for customizing for a particular diver. Such method involves forming a substantially rigid front member which extends from a proximal in-mouth end forwardly toward a distal outside end and forms a horizontal passageway, and thereafter molding a thermoformable U-shaped back member onto the front core member to form the complete mouthpiece.

In highly preferred methods in accordance with this invention, the configuration of the mouthpiece is like that described above. The front member preferably has a groove near its proximal end which serves to facilitate interconnection of the back and front members.

In highly preferred forms of the method of this invention, at least a portion of the front member is not thermoformable during customizing of the back member to the diver's teeth. This allows the front member to aid in mouthpiece shape retention and avoidance of passageway constriction.

In preferred forms of the method of this invention, the front member forming step preferably includes forming a substantially rigid non-thermoformable front core member which extends from the proximal in-mouth end forwardly to a position short of the distal outside end and defines part of the horizontal passageway. In such cases, the subsequent molding step includes molding the remainder of the mouthpiece onto the front core member. Such mouthpiece remainder is of thermoformable material, and includes the back member and a thermoformable front portion which covers the core member and extends forwardly beyond the core member to form the distal outside end. Such thermoformable front portion forms another part of the horizontal passageway. The entire thermoformable portion of the mouthpiece is integrally formed.

As already noted, the method preferably involves a front member which is not softened for thermoforming during later customizing of the back member to the diver's teeth. The use of different materials for the front and back members (or at least for the back member and the core member of the front member) having different characteristics during final customizing, is an important aspect of preferred embodiments of this invention. Suitable materials for preferred embodiments will be described later in this application.

The front member may itself be entirely of one material or, in highly preferred embodiments as already described, have a core member of one material along with a remaining portion of another. However the front member is constructed, it is essential that it have the structural strength necessary for it to carry out its connecting function with respect to the second-stage regulator used in scuba-diving.

It is clear that the term "thermoformable," as applied to the mouthpiece or portions of the mouthpiece of this invention which subsequently engage the teeth and mouth, in fact means "rethermoformable." Before customizing, the mouthpiece members or portions thereof are thermoformed to provide the shape which accommodates the customizing process. The customizing process itself involves rethermoforming such members or portions thereof to take the shapes necessary to allow the mouthpiece to grip the diver's teeth and surrounding mouth tissue.

The mouthpiece and manufacturing method of this invention solve many of the aforementioned problems. A highly superior mouthpiece is provided which offers divers unexcelled comfort and reliability during long diving sessions. The mouthpiece of this invention requires little, if any, energy consumption for gripping purposes; indeed, such mouthpiece essentially grips the teeth of the diver, rather than vice versa.

DETAILED DESCRIPTION OF PREFERRED EMBODIMENTS

Figure 1:
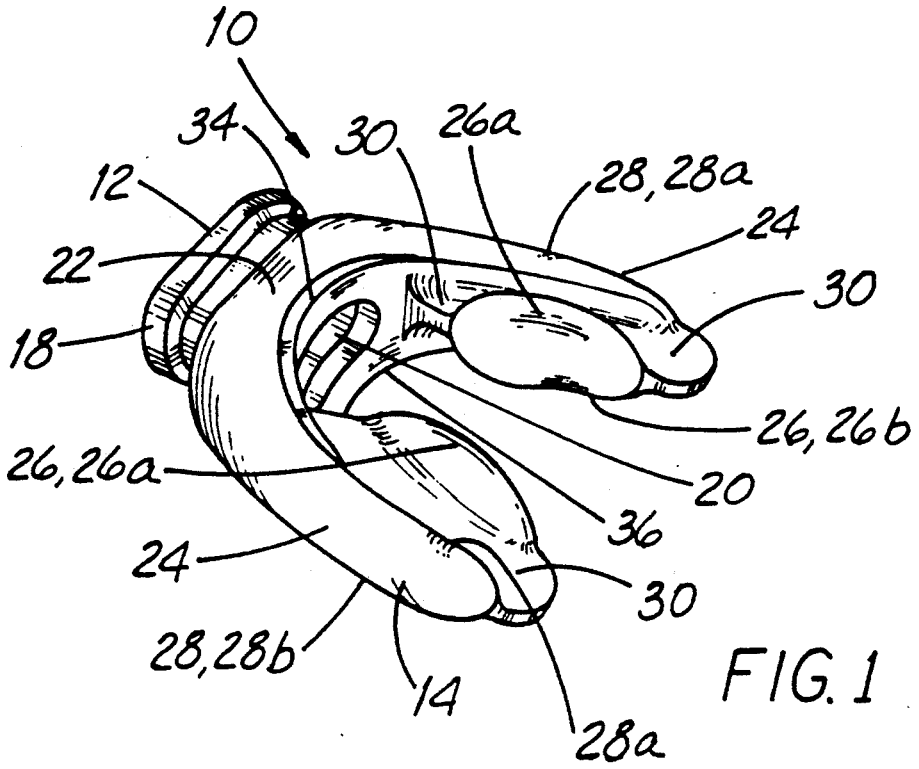
FIG. 1 is a perspective view of a preferred customizable scuba-diving mouthpiece in accordance with this invention.
Figure 4:
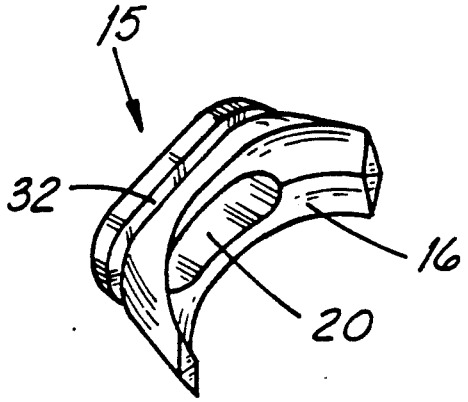
FIG. 4 is a fragmentary perspective of the rigid core member, showing it as it appears prior to molding the back member and remainder of the front member onto such core member.

The figures illustrate a customizable mouthpiece 10 according to this invention. Mouthpiece 10 has a front member 12 and a thermoformable back member 14 which are permanently interconnected during manufacture. Front member 12 includes a rigid non-thermoformable core member 15 and a thermoformable portion 17 which covers core member 15, extends forwardly beyond core member 15 to form distal outside end 18, and is integrally formed with back member 14 during a single molding step. During such step, back member 14 is molded onto front member 12 and its core member 15.

Front member 12 extends from a proximal in-mouth end 16, which is the inner end of core member 15, to distal outside end 18. Front member 12 forms a horizontal passageway 20 which extends from distal end 18 to proximal end 16. Passageway 20 is defined in part by core member 15 and in part by thermoformable portion 17 of front member 12. A second stage regulator (not shown) is secured to front member 12 by insertion of a rigid conduit into passageway 20 and distal end 18, or by other common means.

A variety of materials can be used for rigid core member 15, and core member 15 can be made of any suitable process. It is formed as an initial step in manufacture of customizable mouthpiece 10, well prior to the in-mouth customizing that causes back member 14 to conform in shape to the many unique tooth and mouth surfaces of a particular diver.

Because of core member 15, front member 12 is not modified during such in-mouth customizing. Indeed, during the final customizing process, front member 12 need not even be heated; back member 14 alone can be heated by suspending only that portion of mouthpiece 12 in boiling water without exposing much of front member 12 to the water.

Front member can vary significantly within the scope of this invention, both in the degree or rigidity of its member or members and in the extent to which it may or may not be softened during the final customizing procedures. It is important, however, both that the form of the mouthpiece be maintained and that the back member be readily thermoformable to facilitate customizing as described.

Core member 15 is preferably of a material which is not at all thermoformable at the relatively low temperatures used for customizing back member 14. Thus, core member 15 helps front member 12 retain its shape during the customizing steps. Among other things, this serves to avoid constriction of passageway 20 and other changes which might ruin mouthpiece 10 or interfere with its function. It is also important that the surface of front member 12 properly engage the regulator, and that the surface of passageway 20 retain its shape during the in-mouth molding process.

Examples of suitable materials for core member 15 are: various blends of styrenic TPE (thermoplastic elastomer) and ethylene vinyl acetate; various blends of styrenic TPE and polypropylene; and semi-rigid PVC. Of course, suitable materials will preferably be acceptable to the FDA for intraoral use.

A preferred blend of styrenic TPE and ethylene vinyl acetate would include 95% of KRATON, a styrenic TPE from Shell Chemical, Houston, Texas, and 5% of ELVAX 550, an ethylene vinyl acetate from DuPont, Wilmington, Delaware. Adjusting the relative amounts of KRATON and ELVAX 550 tends to adjust the hardness of core member 15.

A preferred blend of styrenic TPE and polypropylene has 88% of KRATON and 12% of polypropylene FDA blend. Increasing the amount of KRATON in such blend tends to allow the front member to better engage the second-stage regulator.

Back member 14 is a thermoformable U-shaped member having a forward middle portion 22 and a pair of leg portions 24 extending from either end of forward middle portion 22. Leg portions 24 are situated and configured to extend from middle portion 22 rearwardly to pass between the driver's molars and terminate at the rear of the mouth.

Each leg portion 24 has an inner upstanding flange 26, an outer upstanding flange 28, and a substantially horizontal bite portion 30. Each bite portion 30 extends between its adjacent inner and outer upstanding flanges 26 and 28. Each bite portion 30 has substantially constant thicknesses from front to back and side to side, such thickness preferably being at least about 4 mm.

Inner and outer upstanding flanges 26 and 28 have upwardly-extending portions **26*a* and 28*a* and downwardly-extending portions 26*b* and 28*b*. Outer flange 28 extends substantially along the entire U-shape of back member 14, including along forward middle portion 22, while inner flanges 26 terminate well behind forward middle portion 22** to leave room for free air flow.

Bite portions 30 extend from positions forward of inner flanges 26 rearwardly well beyond inner and outer upstanding flanges 26 and 28. This rearward extension, beyond flanges 26 and 28, further facilitates custom engagement between the full molar set of a diver without having flanges at such position which, at such position, could impinge upon sensitive gum tissue in particularly constricted areas of the mouth.

It should be noted that along forward middle portion 22, the downwardly and upwardly-extending portions of outer flanges 28 may not appear to be flanges in the normal sense because of their abutment with proximal end 16 of front member 12. However, they are referred to as "flanges" because they are relatively thin, generally planar members, would appear to be flanges in the normal sense in the absence of front member 12, and are continuations of flange structures which extend along leg portions 24 and allow tooth impressions in important forward positions.

Back member 14 is secured to front member 12 by virtue of the interconnection of forward middle portion 22 to front member proximal end 16, that is, to core member 15 thereof. Such interconnection is by in situ formation of back member 14 on and over proximal end 16 of front member 12. As hereafter explained, in certain highly preferred embodiments the interconnection may be aided by chemical bonding at the interface of back member 14 with front member 12.

After the formation of front member 12, back member 14 is molded in a cavity one end of which, that is, a removable portion of the cavity wall, is proximal end 16 of front member 12. Thus, such cavity end is the inner end of core member 15 of front member 12. Given the configuration of core member 15, this allows firm and permanent interconnection of back member 14 to front member 12. The formation of back member 14 on front member 12 may be referred to as "overmolding."

Core member 15 of front member 12 has a deep groove 32 extending thereabout near proximal end 16. This serves to facilitate the molding interconnection of back member 14 to front member 12.

Figure 3:
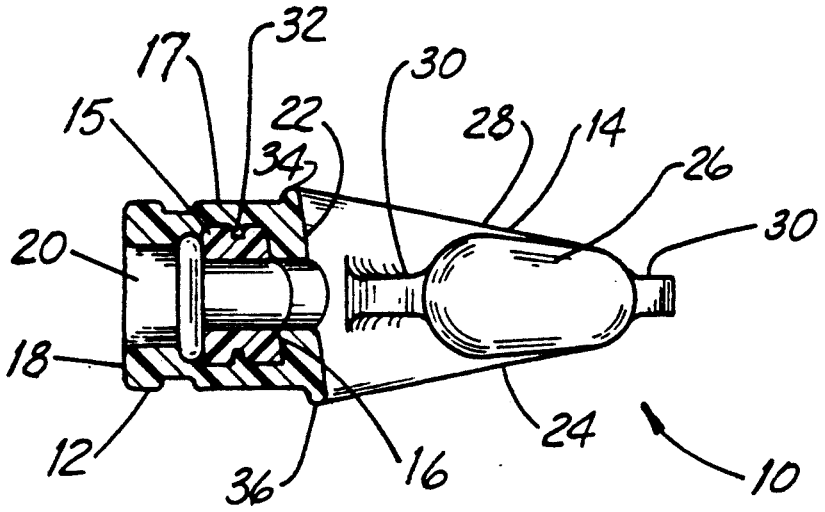
FIG. 3 is a sectional view taken along section 4—4 as indicated in FIG. 3.

Outer flange 28 is angled substantially off-vertical along forward middle portion 22. That is, as shown best in FIG. 3, the upper edge 34 of outer flange 28 is at a position well forward of the lower edge 36 of outer flange 28 along forward middle portion 22. Stated differently, downwardly-extending portion **28*b* is rearwardly offset with respect to upwardly-extending portion 28*a***. This configuration serves to better accommodate typical mouth/tooth orientations.

Suitable materials for back member 14 and the thermoformable portions 17 of front member 12 include ethylene vinyl acetate and ethylene vinyl acetate blends which are softenable, and thus custom moldable in the diver's mouth, at above-ambient temperatures which are low enough to avoid pain during the in-mouth customizing steps. Certain FDA-approved polyvinyl chloride materials may be used instead.

A particularly preferred material for back member 14 is a blend having: 83% of ELVAX 260, an ethylene vinyl acetate having 85 Shore A hardness and a Vicat softening point of 115° F.; and 17% of ELVAX 250, an ethylene vinyl acetate having 80 Shore A hardness and a Vicat softening point of 108° F. The resulting mouthpiece is customizable when at an acceptable temperature for in-mouth molding, which is well under 120° F.

The interconnection of back member 14 with core member 15, while mechanical in nature because of the relative shapes of the joined portions and because core member 15 is essentially surrounded by the material of back member 14, is preferably made even stronger by a degree of chemical bonding at the interface. This is accomplished by appropriate choices of the differing materials for back member 14 and core member 15. One example of such materials which together provide a degree of chemical bonding is the blend of styrenic TPE and ELVAX 550 noted above for core member 15 and the preferred ELVAX 250/260 blend noted above for back member 14. The bonding occurs between the ethylene vinyl acetate constituents. Similar bonding could occur between polyvinyl chloride constituents of the front and back members, when such materials are used.

Figure 5:
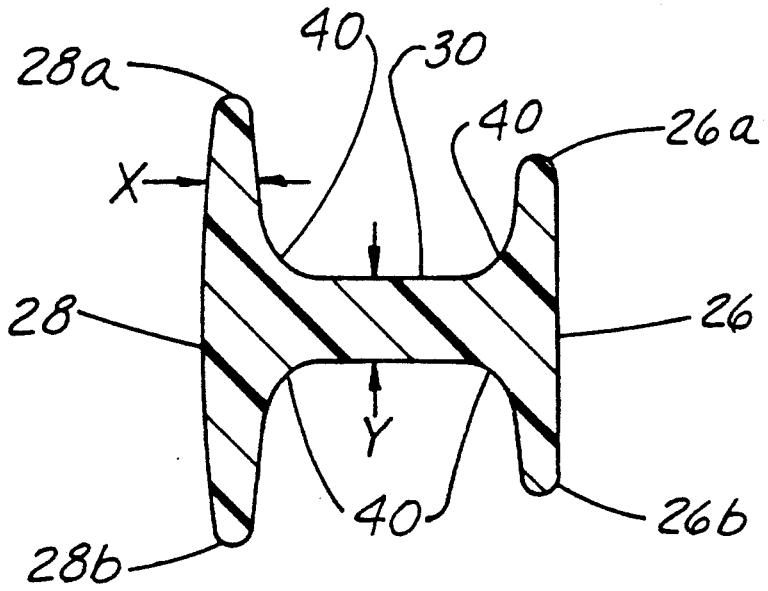
FIG. 5 is an enlarged section, without background, taken along section V—V as indicated in FIG. 2.

Certain relative dimensional characteristics of mouthpiece 10 have been found to be critical for a successful fully customizable mouthpiece. Certain of these relative dimensions are illustrated in FIG. 5. As already noted, bite portions 30 preferably have a vertical thickness (Y) of at least about 4 mm. This serves to provide both good moldability and structural integrity. And, the horizontal dimensions (X) of each flange portion **26*a*, 26*b*, 28*a* and 28*b* at positions midway between their edges and their adjacent bite portions 30** is such that X:Y is about 1:3–1:1. This serves to provide both good moldability and structural integrity.

Furthermore, as also illustrated best in FIG. 5, the intersections of the flange inside surfaces with their adjacent bite portions 30 are substantially beveled, such as by rounded corners 40, to increase customized tooth-surface engagement and to allow good customizing for teeth of divers having significant mouth variations. Such beveling, which are shown in FIG. 2 preferably increases at more forward positions, serves to enhance the grip of mouthpiece 10 on the user's teeth.

Figure 2:
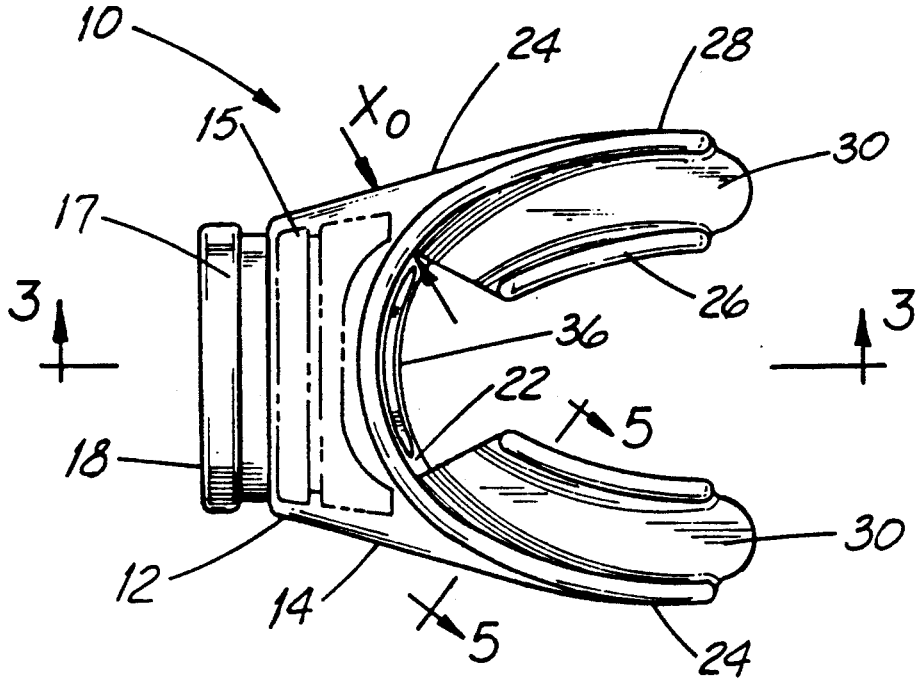
FIG. 2 is a top plan view of the mouthpiece of FIG. 1, with phantom lines to show the relationship of the front and back members and of the rigid core member which forms a part of the front member.

FIG. 2 illustrates another important and highly preferred dimensional relationship, in which the horizontal dimension ($X_o$) of outer flanges 28 at a position forward of the bite portions is such that $X_o$:Y is about 1:1–3:1. This serves to provide good torsional rigidity to resist twisting forces imposed on the mouthpiece during use, and to resist damage from such twisting forces.

Still another important preferred characteristic of mouthpiece 10 is the convergence of upper and lower edges of flanges 26 and 28 at positions progressively more rearward. This serves to facilitate custom engagement with a driver's molar sides while avoiding impingement upon sensitive gum tissue in constricted areas of the mouth.

There is no need to describe precise steps for formation of core member 15 or to describe the apparatus used for the final molding step in which back member 14 and thermoformable portion 17 of front member 12 is molded over core member 15. The disclosure herein is fully adequate to enable the person of ordinary skill in the art to practice the method of this invention.

After formation of customizable scuba-diving mouthpiece 10, it may be easily customized for a particular diver without the need for formation of any intermediate shapes and parts and without the need for extended laboratory processes. The mouthpiece may simply be warmed slightly by exposure to a warm environment, such as hot water, and then inserted into the mouth of the diver such that the diver can bite to customize the tooth-engagement surfaces.

If customizable mouthpiece 10 is made using the most preferred materials noted above, it may be dipped in boiling water for about ten seconds to prepare it for customizing. It is removed from the water and then rather quickly placed into the mouth of the diver so that back member 14 may be molded by the diver's bite. The surface temperature during such bite may be on the order of 120° F. or less, preferably about 110° F. Throughout the heating and biting process, the shape of front member 12 does not change.

During the final customizing step, a plug (not shown) is preferably inserted through passageway 20 to a position which would be between the diver's upper and lower teeth. The biting which customizes mouthpiece 10 is limited by engagement of the upper and lower teeth of the diver with such top and bottom surfaces of the plug. This serves to control the depth of the tooth impressions.

The relative forward and rearward positions of the upper and lower teeth f a diver can be quite natural during the customizing process because of the above-noted angling of outer flange 28. The positioning of the upper and lower teeth during such biting procedure can also be controlled, if desired, by the use of a notch or notches in the bite-limiting plug.

With the customizable scuba-diving mouthpiece of this invention, customized tooth-engagement surfaces will not only be between the molars, that is, along the top and bottom of each horizontal bite portion 30, but along each of the inner and outer upstanding flanges 26 and 28, including the portion of outer flange 28 which is along forward middle portion 22. This proves an excellent and easy mouthpiece grip for the driver, and tends to eliminate or greatly reduce some of the problems mentioned above.

While the principles of this invention have been described in connection with specific embodiments, it should be understood clearly that these descriptions are made only by way of example and are not intended to limit the scope of the invention.

I claim:

1. A scuba-diving mouthpiece for customizing for a particular diver including means for gripping the diver's teeth, such mouthpiece and gripping means comprising:

a front member extending from a proximal in-mouth end to a distal outside end and forming a horizontal passageway from the distal end to the proximal end; and a U-shaped thermoformable back member having:

a forward middle portion secured to the front member proximal end in position for thermoformable custom moldable engagement with the diver's forward teeth; and a pair of leg portions extending from the middle portion rearwardly to pass between the diver's molars and terminate at the rear of the mouth, each leg portion having inner and outer upstanding flanges and a substantially horizontal bite portion extending therebetween, the bite portion having thermoformable custom moldable upper and lower surfaces and the flanges having upwardly-extending and downwardly-extending flange portions with upper and lower edges, respectively, and inside surfaces spaced for thermoformable custom moldable engagement with opposite side surfaces of the user's teeth, said outer flanges extending forward to merge with the forward middle portion.

2. The customizable scuba-diving mouthpiece of claim 1 wherein the back member is secured to the front member by in situ formation thereon.

3. The customizable scuba-diving mouthpiece of claim 2 having means to facilitate interconnection of the back and front members, such interconnection facilitating means comprising a groove near the proximal end of the front member.

4. The customizable scuba-diving mouthpiece of claim 1 having means to aid in mouthpiece shape retention and avoidance of passageway constriction, said shape-retention and constriction-avoidance means comprising at least a major portion of the front member being nonthermoformable during customizing o the back to the diver's teeth.

5. The customizable scuba-diving mouthpiece of claim 4 wherein the front member comprises:

a substantially rigid non-thermoformable core member extending from the proximal in-mouth end forwardly to a position short of the distal outside end and forming part of the horizontal passageway; and a thermoformable portion covering the core member and extending forwardly beyond the core member to form the distal outside end and another part of the horizontal passageway, said thermoformable portion being integrally formed with the back member.

6. The customizable scuba-diving mouthpiece of claim 1 having means to further improve the grip of the mouthpiece of the diver's teeth, such grip-improvement means comprising:

the bite portions having a vertical thickness (Y) of at least about 4 mm; and the horizontal dimension (X) of each flange portion along the adjacent bite portion at a position midway between its edge and the bite portion being such that X:Y is about 1:3–1:1: and the intersections of the flange inside surfaces with their adjacent bite portion being beveled to increase customized tooth-surface engagement.

7. The customizable scuba-diving mouthpiece of claim 6 wherein the back member is secured to the front member by in situ formation thereon.

8. The customizable scuba-diving mouthpiece of claim 7 having means to facilitate interconnection of the back and front members, such interconnection facilitating means comprising a groove near the proximal end of the front member.

9. The customizable scuba-diving mouthpiece of claim 6 having means to aid in mouthpiece shape retention and avoidance of passageway constriction, said shape-retention and constriction-avoidance means comprising at least a major portion of the front member being nonthermoformable during customizing of the back member to the diver's teeth.

10. The customizable scuba-diving mouthpiece of claim 9 wherein the front member comprises:

a substantially rigid non-thermoformable core member extending from the proximal in-mouth end forwardly to a position short of the distal outside end and forming part of the horizontal passageway; and a thermoformable portion covering the core member and extending forwardly beyond the core member to form the distal outside end and another part of the horizontal passageway, said thermoformable portion being integrally formed with the back member.

11. The customizable scuba-diving mouthpiece of claim 6 having means to provide torsional rigidity to resist twisting forces during use, said twist-resistance means comprising the horizontal dimension ($X_o$) of the outer flanges at a position forward of the bite portions being such that $X_o$:Y is about 1:13:1.

12. The customizable scuba-diving mouthpiece of claim 6 having means for full molar engagement without impinging upon sensitive gum tissue in rear constricted areas of the mouth, said full-engagement means comprising the bite portions extending rearwardly beyond the upstanding flanges to positions for engagement along the diver's full molar sets.

13. The customizable scuba-diving mouthpiece of claim 6 wherein the upper and lower edges converge rearwardly.

14. A method for making a non-customized scuba-diving mouthpiece for later customizing for a particular diver comprising:

forming a substantially rigid front member which extends from a proximal in-mouth end forwardly toward a distal outside end and forms a horizontal passageway;

thereafter molding a thermoformable U-shaped back member onto the front member to form the complete mouthpiece, providing said back member with a forward middle portion secured to the front member proximal end in position for thermoformable custom moldable engagement with the diver's forward teeth and a pair of leg portions extending from the middle portion rearwardly to pass between the diver's molars and terminate at the rear of the mouth providing each leg portion with an inner and an outer upstanding flange and a substantially horizontal bite portion extending therebetween, providing the bite portion with thermoformable custom moldable upper and lower surfaces and the flanges having upwardly-extending and downwardly-extending flange portions with upper and lower edges, respectively, and providing inside surfaces spaced for thermoformable custom moldable engagement with opposite side surfaces of the user's teeth, said outer flanges extending forward to merge with the forward middle portion.

15. The method of claim 19 wherein the front member has a groove near its proximal end.

16. The method of claim 14 wherein at least a portion of the front member is not thermoformable during subsequent customizing of the back member to the diver's teeth.

17. The method of claim 16 wherein:

the front member forming step includes forming a substantially rigid non-thermoformable front core member which extends from the proximal in-mouth end forwardly to a position short of the distal outside end and defines part of the horizontal passageway; and the subsequent molding step includes molding the remainder of the mouthpiece onto the front core member, said remainder being of thermoformable material and including the back member and a thermoformable front portion which covers the core member and extends forwardly beyond the core member to form the distal outside end and another part of the horizontal passageway, said thermoformable remainder being integrally formed.

* * * * *

UNITED STATES PATENT AND TRADEMARK OFFICE

CERTIFICATE OF CORRECTION

PATENT NO. : 5,305,741

DATED : April 26, 1994

INVENTOR(S) : Randall C. Moles

It is certified that error appears in the above-indentified patent and that said Letters Patent is hereby corrected as shown below:

In column 1, line 5, the subtitle should read --Related Applications--.

In column 10, line 57, change "are" to --as--.

In column 11, line 42, change "teeth f" to --teeth of--.

In column 11, line 54, delete "proves" and insert --provides--.

In claim 4, line 6, change "o the" to --of the--. In line 7 of the same claim, after "back" insert --member--.

In claim 11, the last line, change "1:13:1" to --1:1-3:1--.

In claim 15, line 1, delete "19" and insert --14--.

Signed and Sealed this

Thirteenth Day of September, 1994

*Attest:*

*Attesting Officer*

BRUCE LEHMAN

*Commissioner of Patents and Trademarks*